United States Patent [19]

Smith

[11] 4,332,524

[45] Jun. 1, 1982

[54] BEARING AND FILTER ARRANGEMENT FOR SUBMERSIBLE PUMPS

[75] Inventor: Roy Smith, Beatrice, Nebr.

[73] Assignee: Dempster Industries, Inc., Beatrice, Nebr.

[21] Appl. No.: 98,597

[22] Filed: Nov. 29, 1979

[51] Int. Cl.[3] ..... F01D 25/22

[52] U.S. Cl. ..... 415/176; 417/424; 308/76; 308/80; 308/134.1

[58] Field of Search ..... 415/176; 417/424; 308/76, 78, 80, 134.1

[56] References Cited

U.S. PATENT DOCUMENTS

| | | | |
|---|---|---|---|
| 2,648,286 | 8/1953 | Bergh | 417/424 |
| 2,851,956 | 9/1958 | Lung | 415/176 |
| 3,355,229 | 11/1967 | Sadler | 308/78 |
| 3,397,644 | 8/1968 | Einerson et al. | 415/176 |
| 3,495,537 | 2/1970 | Archibald | 417/424 |

*Primary Examiner*—Robert E. Garrett

*Attorney, Agent, or Firm*—Kokjer, Kircher, Bradley, Wharton, Bowman & Johnson

[57] ABSTRACT

A sleeve bearing and filter for reducing the wear on a submersible electric pump used to pump fluids containing abrasive materials such as sand. The sleeve bearing receives the upper end of the pump shaft and is equipped with a sintered bronze filter element which restricts the flow of abrasives between the shaft and bearing while permitting sufficient fluid flow for lubrication purposes.

4 Claims, 2 Drawing Figures

BEARING AND FILTER ARRANGEMENT FOR SUBMERSIBLE PUMPS

BACKGROUND AND SUMMARY OF THE INVENTION

This invention relates generally to pumps and more particularly to an improved bearing arrangement for the drive shaft of a submersible pump.

Submersible electric pumps are frequently used to pump well water and other fluids containing abrasive materials such as sand and the like. Typically, the upper end of the drive shaft of the pump is received by a sleeve bearing which allows the water to flow between it and the shaft for lubrication purposes. However, the abrasive materials in the water can cause undue wear on the shaft and bearing, particularly in newly developed wells which tend to contain substantial amounts of sand. Such damage to the components makes the bearing incapable of maintaining the pump shaft in the proper alignment, resulting in inefficiency of the pump or complete pump failure in some cases.

A related problem arises when the pump operation is stopped and the abrasive materials are allowed to settle down into the pump head. The abrasives can then enter the bearing from above and become wedged between the outside of the shaft and the inside of the sleeve bearing. This causes binding of the shaft and can result in failure of the pump to start at all.

It is thus apparent that a need exists for an improved bearing arrangement which reduces the problems associated with the pumping of fluids containing abrasive materials such as sand and the like. It is the primary goal of the present invention to meet that need.

More specifically, it is an object of the invention to provide, in a submersible pump, a sleeve bearing having a filter element therein which reduces the flow of abrasive materials between the bearing and pump shaft while at the same time permitting sufficient flow for proper lubrication of the pump components.

Another object of this invention is to provide a bearing and filter arrangement which prevents abrasive materials from passing downwardly into the area between the drive shaft and bearing.

A further object of the invention is to provide a bearing and filter arrangement which is simple and economical to construct and install and which significantly increases the operating life of the shaft and bearing.

Other and further objects of the invention, together with the features of novelty appurtenant thereto, will appear in the course of the following description.

DETAILED DESCRIPTION OF THE INVENTION

Figure 1:
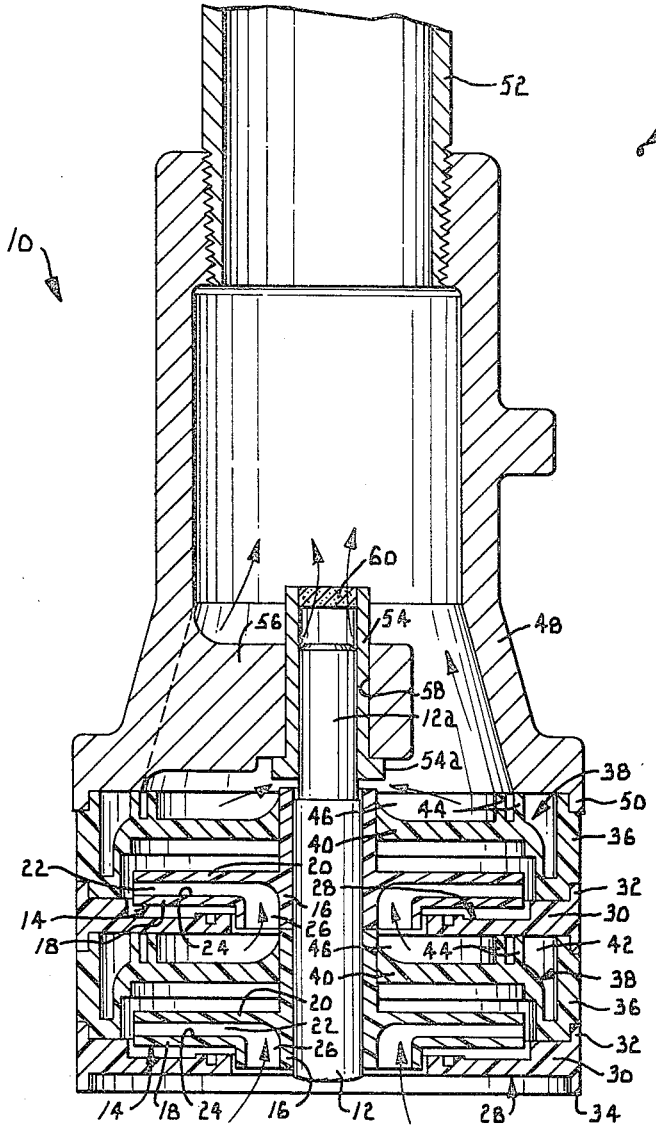
Figure 2:
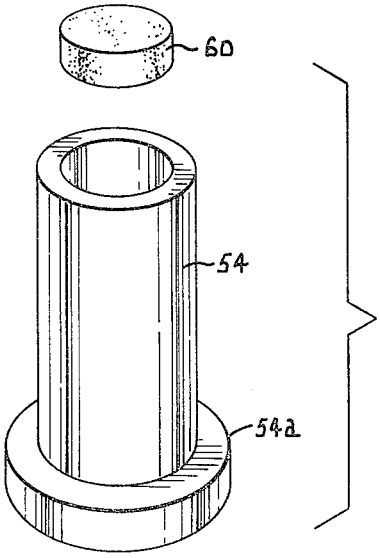

In the accompanying drawing, which forms a part of the specification and is to be read in conjunction therewith, and in which like reference numerals are used to indicate like parts in the various views:

FIG. 1 is a fragmentary sectional view of a submersible electric pump which is equipped with a sleeve bearing and filter element constructed according to a preferred embodiment of the present invention; and FIG. 2 is an exploded perspective view of the sleeve bearing and filter element shown in FIG. 1.

Referring now to the drawing in detail, numeral 10 generally designates a submersible electric pump which is used to pump well water and other fluids that may contain abrasive materials. Pump 10 is constructed conventionally for the most part and includes a submersible electric motor (not shown) which is drivingly coupled with the lower end of a pump shaft 12. The lower end of shaft 12 is suitably journaled near the bottom or intake end of the pump. The pump housing includes the usual shell (not shown) which extends between the lower inlet end of the pump and an upper discharge head which will subsequently be described. Pump 10 is a multistage pump having a plurality of impellers 14 carried on hubs 16 which are fitted on shaft 12 and connected thereto by splines or the like (not shown). Each impeller 14 has lower and upper shrouds 18 and 20 and a plurality of curved vanes 22 which direct fluid outwardly within the impeller through a generally radial passage 24 located between the vanes and shrouds 18 and 20. Each passage 24 has an inlet 26 located adjacent to hub 16.

Underlying each impeller 14 is a diffuser disc 28 having an enlarged rim portion 30 on its outer periphery. Upper and lower flanges 32 and 34 project from the rim of each diffuser disc and interfit with grooves formed in an outer wall portion 36 of a diffuser bowl 38 included in each stage of the pump. Each diffuser bowl 38 has a disc portion 40 adjacent hub 16. A small duct 42 is formed in each bowl 38 in communication with the outlet end of the corresponding impeller passage 24. A pair of curved vanes 44 are formed on the upper surface of each disc 40 to direct fluid inwardly from duct 42 into a passage 46 which connects with the inlet 26 of the next impeller passage.

The upper stage of the pump connects with a hollow discharge head 48 having a flange 50 on its lower end which interfits with the upper groove in wall 36 of the upper diffuser bowl 38. The fluid passing through the pump is thus directed upwardly from the upper passage 46 and through the hollow interior of discharge head 48. A hollow conduit 52 is threaded to the top end of discharge head 48 to direct the fluid upwardly.

The construction and operation of pump 10 are substantially the same as the pump shown in U.S. Pat. No. 3,477,384, which is incorporated herein by reference. However, the arrangement provided by the present invention is not limited to any particular type of pump and may be used with any suitable submersible pump.

In accordance with the invention, the top end of pump shaft 12 is reduced in diameter as indicated at **12*a* and is received within a hollow sleeve bearing 54 mounted to an internal lug 56 projecting from discharge head 48. Bearing 54 is closely fitted in an opening 58 formed in lug 56 and is suitably secured to the lug. An enlarged flange 54*a* is formed on the lower end of bearing 54 and is positioned against the underside of lug 56 a slight distance above the upper hub 16. Shaft portion 12*a* fits rather loosely in bearing 54 such that the fluid being pumped is able to pass upwardly between the outer diameter of shaft portion 12*a* and the inside diameter of bearing 54**. This fluid flow is for the purpose of lubricating the shaft and bearing.

A filter 60 is press fitted into bearing 54 at the top end thereof above the upper end of shaft portion **12*a*. Filter 60 is a disc shaped element which is preferably formed of a porous metal substance such as sintered bronze. Although any suitable material can be used, it is preferred that filter 60 be constructed by combining selected metal powders and compacting them under pressure and/or heat until they become permanently bonded. This sintering technique results in the formation of a permanent metal matrix having a porosity in the range of approximately 35% to 65%, with approximately 50% porosity being preferred in most applications of the pump. The matrix can be formed such that it is capable of filtering out particles of any desired size, depending on the particle size expected to be encountered in a particular application of the pump. In a preferred form of the invention, filter 60** is sintered bronze having a chemical composition of 89% to 96% copper with the balance being tin.

In operation of pump 10, shaft 12 is rotated by the electric motor (not shown) to drive impellers 14. The fluid drawn into the lower or inlet end of the pump is thereby pumped upwardly into the inlet 26 of each impeller, outwardly through passage 24, upwardly through duct 42, and then inwardly through passage 46 of each pump stage until the fluid eventually passes through each stage of the pump and reaches discharge head 48. The fluid is then directed out of the pump through the discharge end which connects with conduit 52.

Due to the loose fit of shaft portion 12*a* in sleeve bearing 54, a small clearance space is provided between the outside diameter of the shaft and the inside diameter of the bearing. Consequently, fluid is able to flow through the clearance space to adequately lubricate shaft 12 and bearing 54. The porosity of filter 60 is selected such that the fluid is able to pass through the filter in sufficient quantity to effect adequate lubrication of the pump components. At the same time, the restriction to fluid flow provided by filter 60 reduces the fluid flow through bearing 54 in comparison to that which would occur in the absence of a filter in the bearing. Consequently, when the fluid contains significant quantities of abrasive materials such as sand, the flow of abrasive materials passing between the shaft and bearing is reduced, resulting in reduced abrasion and wear on the shaft and bearing. It is thus apparent that filter 60 reduces the wear and abrasion on the components while assuring that they are adequately lubricated by the fluid.

When pump 10 is stopped, the abrasive materials in discharge head 48 are allowed to settle downwardly into the discharge head. However, due to the presence of filter 60, the abrasive materials are prevented from entering bearing 54 from the top. Consequently, filter 60 eliminates the problem of abrasive materials settling into the top of bearing 54 and becoming wedged between the outside diameter of shaft portion 12*a* and the inside diameter of bearing 54.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible enbodiments may be made of the invention without departing from the scope thereof, it is to be understood that all matter herein set forth or shown in the accompanying drawings is to be interpreted as illustrative and not in a limiting sense.

Having thus described my invention, I claim:

1. In a submersible pump having a housing with inlet and discharge ends and a fluid flow passage between said ends, a rotary drive shaft in the housing having an upper end, and an impeller mounted on said shaft for rotation therewith to pump fluid through said passage from the inlet end to the discharge end, the improvement comprising:

a hollow sleeve bearing supported on the housing and receiving the upper end of said shaft to assist in maintaining the alignment thereof, said shaft fitting loosely in said sleeve bearing to provide a clearance space communicating with said flow passage to permit fluid flow between said shaft and bearing for lubrication purposes; and a filter element mounted in said sleeve bearing above the upper end of said drive shaft, said filter element being formed of a porous substance restricting fluid flow through said clearance space while permitting fluid flow therethrough in sufficient quantity to lubricate the shaft and bearing, said filter element substantially preventing abrasive materials in the fluid such as sand and the like from passing downwardly through said filter element into said clearance space.

2. The improvement set forth in claim 1, wherein said filter element is formed of a sintered metal substance.

3. The improvement set forth in claim 1, wherein said filter element is formed of sintered bronze.

4. The improvement set forth in claim 1, wherein said filter element has a porosity in the range of approximately 35% to 65%.

* * * * *